US007189308B2

(12) United States Patent
Feit et al.

(10) Patent No.: US 7,189,308 B2
(45) Date of Patent: Mar. 13, 2007

(54) TREATED PAPER PRODUCT

(75) Inventors: Susan L. Feit, Mosinee, WI (US); David J. Langton, Mosinee, WI (US); Michael A. Orlovsky, Wausau, WI (US); Mark J. Weber, Stevens Point, WI (US); John J. Blanz, Mosinee, WI (US); Lisa R. Schultz, Hatley, WI (US)

(73) Assignee: Wausau Paper Corp., Mosinee, WI (US)

( * ) Notice: Subject to any disclaimer, the term of this patent is extended or adjusted under 35 U.S.C. 154(b) by 345 days.

(21) Appl. No.: 10/291,810

(22) Filed: Nov. 8, 2002

(65) Prior Publication Data

US 2004/0091585 A1 May 13, 2004

(51) Int. Cl.

| | |
|---|---|
| ***D21H 17/60*** | (2006.01) |
| ***D21H 21/16*** | (2006.01) |
| ***D21H 21/20*** | (2006.01) |
| ***B65D 81/26*** | (2006.01) |
| ***B65D 85/00*** | (2006.01) |

(52) U.S. Cl. ..... 162/180; 162/135; 162/158; 426/124; 428/484.1

(58) Field of Classification Search ..... 162/135, 162/158, 164.1, 172, 180, 179, 169; 426/124; 156/60, 289; 427/358–361, 391; 428/32.82, 428/40.5, 205, 348, 484.1

See application file for complete search history.

(56) References Cited

U.S. PATENT DOCUMENTS

| | | | | | |
|---|---|---|---|---|---|
| 1,607,552 | A | * | 11/1926 | Maze | 162/172 |
| 1,762,930 | A | * | 6/1930 | Manson | 162/172 |
| 1,942,438 | A | * | 1/1934 | Manson | 162/172 |
| 2,142,986 | A | * | 1/1939 | Arnold, Jr. | 162/172 |
| 2,343,065 | A | * | 2/1944 | Kumler et al. | 106/271 |
| 2,637,665 | A | * | 5/1953 | Dodge | 162/172 |
| 3,241,968 | A | * | 3/1966 | Garth | 430/538 |
| 3,525,668 | A | * | 8/1970 | Goldstein | 162/169 |
| 3,711,314 | A | * | 1/1973 | Campbell | 427/301 |
| 3,985,932 | A | * | 10/1976 | Porter | 428/326 |
| 4,371,553 | A | | 2/1983 | Gilling et al. | |
| 4,375,482 | A | | 3/1983 | Maroszek et al. | |
| 4,487,657 | A | * | 12/1984 | Gomez | 162/158 |
| 4,919,724 | A | * | 4/1990 | Cenisio et al. | 106/192.1 |
| 5,117,717 | A | | 6/1992 | Mally | |
| 5,160,484 | A | * | 11/1992 | Nikoloff | 427/439 |
| 5,456,800 | A | * | 10/1995 | Tansley et al. | 162/158 |
| 5,695,608 | A | * | 12/1997 | Yagi et al. | 162/135 |
| 5,853,542 | A | * | 12/1998 | Bottorff | 162/168.2 |
| 5,858,173 | A | * | 1/1999 | Propst, Jr. | 162/164.1 |
| 5,865,953 | A | * | 2/1999 | Rottger et al. | 162/184 |
| 5,876,815 | A | * | 3/1999 | Sandstrom et al. | 428/36.8 |
| 5,989,696 | A | | 11/1999 | McCarthy et al. | |
| 6,263,640 | B1 | | 7/2001 | Handel | |
| 6,270,577 | B1 | * | 8/2001 | Shanton et al. | 118/249 |
| 6,740,373 | B1 | * | 5/2004 | Swoboda et al. | 428/34.2 |
| 6,852,198 | B1 | * | 2/2005 | Yamazaki et al. | 162/169 |
| 6,919,111 | B2 | * | 7/2005 | Swoboda et al. | 428/34.2 |
| 2003/0127204 | A1 | * | 7/2003 | Varnell | 162/135 |
| 2004/0091585 | A1 | * | 5/2004 | Theisen et al. | 426/124 |

FOREIGN PATENT DOCUMENTS

WO WO 200214426 A1 * 2/2002

OTHER PUBLICATIONS

"Indirect Food Additives: Paper and Paperboard Components" Electronic Coe of Federal Regulations C.F.R. §176.110-§176.350, Feb. 1, 2006.*

* cited by examiner

*Primary Examiner*—José A. Fortuna
(74) *Attorney, Agent, or Firm*—Merchant & Gould P.C.

(57) ABSTRACT

A treated paper product is provided according to the invention. The treated paper product comprises a result of applying a water based emulsion to a paper base sheet to provide an impregnated paper product, and drying the impregnated paper product to a water content of less than about 8 wt. % to provide the treated paper product. The water based emulsion includes a barrier and/or release forming component comprising at least one of stearylated melamine, polyethylene wax, paraffin wax, isoparaffin wax, microcrystalline wax, fluoropolymer wax, silicone wax, alkyl ketene materials, octyl succinic anhydride, Werner chrome complex, natural wax, and mixtures thereof. The water based emulsion can have a solids content of between about 2 wt. % and about 50 wt. % when it is applied to the paper base sheet. Methods for manufacturing and using the treated paper product, and a combination food and treated paper product are provided.

2 Claims, 1 Drawing Sheet

TREATED PAPER PRODUCT

FIELD OF THE INVENTION

The invention relates to a treated paper product, a combination food and treated paper product, a method for manufacturing a treated paper product, and a method for using a treated paper product. In particular, the treated paper product is a result of applying a water based emulsion to a paper base sheet on a paper manufacturing machine without a step of off machine waxing the paper base sheet or poly coating the paper base sheet. The treated paper product can be used in combination with food products including bacon, ice cream cones, cheese, meat, and quick service food items.

BACKGROUND OF THE INVENTION

Waxed paper products are available and are often used in food contact applications. In general, waxed paper products are often manufactured by applying a melted wax to a paper substrate, allowing the wax to soak into the paper, and then cooling the coated paper product. This process is often referred to as "dry waxing" and can be carried out by converters who purchase the paper substrate in rolls, treat the paper substrate with melted wax, and then sell the waxed paper product. Exemplary waxes often found on traditional off line waxed paper products include paraffin wax, isoparaffinic wax, microcrystalline wax, and mixtures thereof, and can include other additives that improve wax sheet performance. The process for manufacturing a waxed paper product by "dry waxing" can be referred to as a two step process because the first step involves manufacturing of the paper substrate and the second step involves applying wax to the paper substrate.

Poly coating refers to a technique where a polymer that is solid under room temperature is placed in an extruder, heated, and extruded onto the surface of a paper substrate or paper product. Exemplary polymers used in poly coating include polyethylene, polypropylene, and polyester. Polyethylene polymer refers to a composition having a higher molecular weight than polyethylene containing waxes.

SUMMARY OF THE INVENTION

Figure 1:
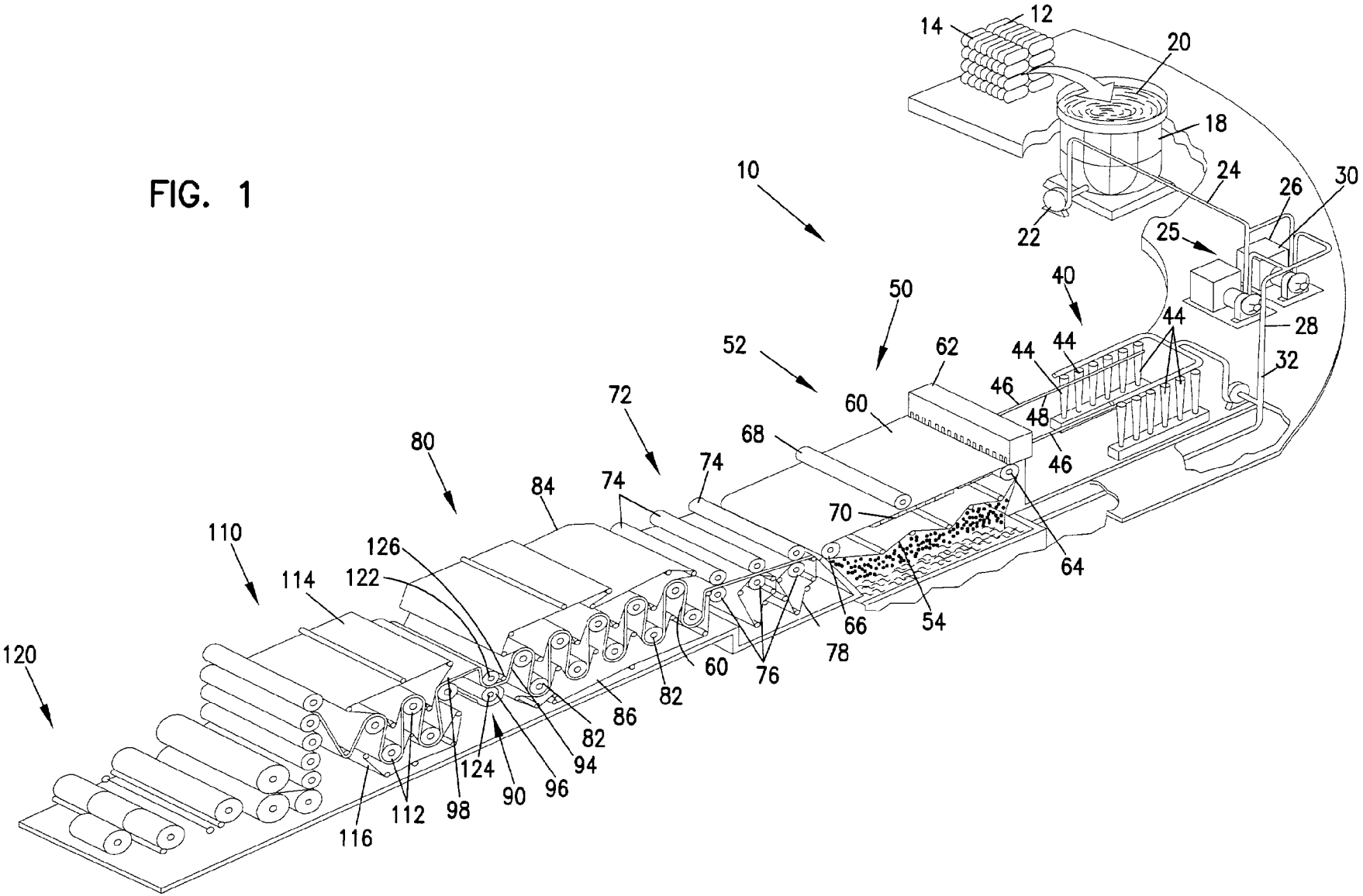
FIG. 1 is a diagrammatic view of an exemplary process for manufacturing a treated paper product according to the invention.

A treated paper product is provided according to the invention. The treated paper product comprises a result of applying a water based emulsion to a paper base sheet to provide an impregnated paper product, and drying the impregnated paper product to a water content of less than about 8 wt. % to provide the treated paper product. The water based emulsion includes a barrier and/or release forming component that includes at least one of stearylated melamine, paraffin wax, isoparaffin wax, microcrystalline wax, fluoropolymer wax, silicone wax, alkyl ketene materials, octyl succinic anhydride, Werner chrome complex, natural wax, and mixtures thereof. The water based emulsion can have a solids content of between about 2.0 wt % and above 50 wt. % when it is applied to the paper base sheet. The treated paper product can be used as a bacon board core stock, an ice cream cone wrapper, an interleaver, and a quick service food wrap.

A method for manufacturing a treated paper product is provided according to the invention. The method includes steps of manufacturing a paper base sheet on a paper manufacturing machine; drying the paper base sheet to a water content of between about 0 and about 15 wt. %; applying a water based emulsion to the paper base sheet to provide a treated paper base sheet, wherein the water based emulsion comprises at one of stearylated melamine, polyethylene wax, paraffin wax, isoparaffin wax, microcrystalline wax, fluoropolymer wax, silicone wax, alkyl ketene materials, octyl succinic anhydride, Werner chrome complex, natural wax, and mixtures thereof; and drying the paper base sheet to a water content of less than about 8 wt. % to provide the treated paper product.

An interleaver is provided according to the invention. The interleaver can be prepared by applying a water based emulsion to a paper base sheet to provide an impregnated paper product and drying the impregnated paper product to product to provide an interleaver exhibiting the following properties: a MacBeth brightness according to TAPPI T452 of at least about 83%; a wet tensile strength (CD) according to TAPPI T456 of at least about 2 lb./in.; a wet tensile strength (MD) according to TAPPI T456 of at least 6 lb./in.; a Tear CD-Elmendorf according to TAPPI T-414 of less than about 55 $g_f$; a Tear MD-Elmendorf according to TAPPI T-414 of less than about 45 $g_f$; a short span compressive strength (STFI)-CD according to TAPPI T-426 of at least about 10 lb./in.; and a short span compressive strength (STFI)-MD according to TAPPI T-826 of at least about 4 lb./in.

An ice cream cone wrap is provided according to the invention. The ice cream cone wrap can be prepared by applying a water based emulsion to a paper base sheet to provide an impregnated paper product and drying the impregnated paper product to provide an ice cream cone wrap. The ice cream cone wrap can exhibit the following properties: a cobb size (2 min., felt) according to TAPPI T441 of between about 15 and about 32 g/m$^2$; a MacBeth brightness according to TAPPI T452 of at least about 80%; a felt-side smoothness according to TAPPI T538 of less than about 240 SSU; a wire-side smoothness according to TAPPI T538 of less than about 240 SSU; felt-side wax pick test according to TAPPI T459 of at least 20 CWSN; and a wire-side wax pick test according to TAPPI T459 of at least about 20 CWSN.

A quick service food wrap is provided according to the invention. The quick service food wrap can be prepared by applying a water based emulsion to a paper base sheet to provide an impregnated paper product and drying the impregnated paper product to provide a quick service food wrap. The quick service food wrap can exhibit the following properties: a wet tensile ratio according to TAPPI T-410 of at least 5% oleic acid resistance of greater than 30 seconds; a Dupont water repellency of at least 2; and a water cobb according to TAPPI T441 of less than 25 g/m$^2$.

A bacon board core stock can be provided according to the invention. The bacon board core stock can be prepared by applying a water based emulsion to a paper base sheet to provide an impregnated paper product and drying the impregnated paper product to provide a bacon board core stock. The bacon board core stock can exhibit the following properties: a Sheffield Smoothness according to TAPPI T538 of less than 200 Sheffield units; a Hercules size test (HST) at 80% reflectance #2 ink of at least 100 seconds; a water cobb according to TAPPI T441 of less than 30 g/m$^2$; and an edge wicking weight gain of less than 6%.

Methods for using the bacon board core stock, the ice cream cone wrap, the interleaver, the quick service food wrap are provided according to the invention. The ice cream cone wrap can be used by contacting the ice cone wrap with an ice cream cone. The interleaver can be used by contacting the interleaver with at least one of slices of cheese, slices of meat, slices of butter and meat patties. The quick service food wrap can be used by wrapping a sandwich with the quick service food wrap. The bacon board core stock can be used by coating opposed surfaces of the bacon board core stock to provide a laminate, and then contacting the laminate with bacon and packaging the combination of the laminate and bacon.

A combination food and treated paper product is provided according to the invention. The food item can be provided in contact with the treated paper product. The food item can include at least one of slices of cheese, slices of meat, meat patties, bacon, ice cream cone, and sandwich. When the food product is bacon, the treated paper product can include a polymer coating on opposed surfaces, wherein the polymer coating comprises at least one of low density polyethylene, medium density polyethylene, high density polyethylene, linear low density polyethylene, polypropylene, polyamide, ionomer, polyvinylidene chloride, ethylene vinyl alcohol, ethylene vinyl acetate, and mixtures thereof.

DETAILED DESCRIPTION

A treated paper product can be prepared by applying a water based emulsion to a paper base sheet. The water based emulsion is applied as a liquid and is dried to form a treated paper product having desired barrier and/or release properties. It is expected that the treated paper product will be useful in applications where barrier and/or release properties are desirable. Exemplary barrier properties include grease resistance and water holdout. When grease and water holdout is desirable, the treated paper product can be provided so that a drop of water placed on a top surface of the treated paper product will not wick through to the bottom surface of the treated paper product. Release properties can be desirable in either a wet or dry environment. In the case of a wet environment, it is expected that the treated paper product will exhibit release properties without disintegration of the treated paper product. An area in which the treated paper product according to the invention is expected to be useful is in food contact applications. Exemplary food contact applications include bacon board core stock, quick service food wrap, ice cream cone wrap, and an interleaver for cheese and meat.

The water based emulsion can be referred to more simply as the emulsion. The emulsion can be characterized as having a large amount of water that allows the emulsion to flow and penetrate into the paper base sheet in order to form a layer within or on the paper base sheet. In addition, the water based emulsion includes a chemical barrier and/or release component suspended in the water that remains after the water has been evaporated to provide a surface having hydrophobic, oleophobic, and/or release properties. The water based emulsion can have a solids content of between 2.0 wt. % and about 50 wt. % when it is applied to the paper base sheet.

The chemical barrier and/or release component of the emulsion is primarily responsible for providing the desired barrier and/or release properties for the treated paper product. The chemical barrier and/or release component of the emulsion can be any material that forms desired barrier and/or release properties when the water is evaporated and that provides a resulting coating that can be characterized as FDA compliant for food contact with aqueous and fatty foods. Exemplary barrier and/or release components include paraffin wax, polyethylene wax, isoparaffinic wax, microcrystalline wax, natural wax such as carnuba and bees wax, stearylated melamine, alkyl ketene materials wherein the alkyl group contains at least about 8 carbon atoms, octyl succinic anhydride, Werner chrome complex, and silicones. Exemplary emulsions containing stearylated melamine are available under the names Bersize S-175, Bersize 6103, and Berbond 8040 from Bercen; Norpel 7650, Norpel IT, Norpel 7645, Norpel 7640M, Norpel 7685, Norpel 1050, and Norpel 1100 from Northern Products; and Sequapel 414, Sequapel 409, 3058-3B, and Sequapel 407 from RohmNova. Exemplary emulsions that contain different active ingredients are available under the names Sansize FE-125, a cyclic amine polymer from PPG; EV-XWP, a polyethylene terephthalate (PET) from Evcote; Microspersion 230, a polyethylene emulsion from Micro Powders, Inc., and EXP571TF, a non fluorochemical grease resistant from Michelman. It is believed that certain chemical barrier and/or release components can be formed in situ. An exemplary chemical barrier and/or release component that can be formed in situ is stearylated melamine by a reaction of stearic acid and melamine. It is believed that heat supplied during the paper drying step will cause the stearic acid and melamine to react to form stearylated melamine.

The emulsion can be applied as an admixture containing additional components including other polymeric film formers, viscosity control agents, and fillers that provide the sheet with desired performance attributes and surface properties for the end use application. Exemplary polymeric film formers that can be incorporated into the emulsion include oxidized starches, ethylated starches, cationic starches, unmodified starches, proteins, starch latex graft copolymers, polyvinyl acrylates, polystyrene acrylate, styrene butadiene, polyvinyl alcohol, vinyl acetate acrylic, styrene acrylates, vinyl acetate, styrene maleic anhydride, and mixtures thereof. Exemplary viscosity control agents that can be incorporated into the emulsion include sodium alginate, sodium carboxymethyl cellulose, hydroxy ethyl cellulose, poly sodium acrylate, guar gum, gum arabic, xanthan gum, and mixtures thereof. Exemplary fillers that can be incorporated into the emulsion include clay, polystyrene micro spheres, calcium carbonate, talc, titanium dioxide, silica, and mixtures thereof.

The emulsion can be applied to the paper base sheet during the paper manufacturing process. That is, the emulsion can be applied to the paper base sheet on a paper manufacturing machine. By applying the emulsion to the paper base sheet during the paper manufacturing process, it is possible to avoid the application of certain surface treating chemicals normally used in the paper manufacturing business when the paper is intended to be coated with a melted wax in an off line operation. Exemplary surface treating chemicals normally used in the paper manufacturing business include starch and polyvinyl alcohol. By applying the emulsion according to the invention, it is possible to avoid the use of such surface treating chemicals or use less of such surface treating chemicals than normally used when manufacturing paper for dry wax coating in an off line operation. It may be desirable to use a certain amount of the surface treating chemicals in order to help keep surface fibers bonded. It is also possible to change the wet end additives refining and furnish to work synergistically with the emulsion in a way not possible in the two-step process. In addition, by applying the emulsion to the paper base sheet during the paper manufacturing process, it is possible to avoid a separate application of dry wax to the paper product. Because dry waxing is often carried out by converters at a location different from the paper making facility, it is possible to avoid having to send the paper base sheet to a converter for the application of dry wax.

By applying the emulsion to the paper base sheet on the paper manufacturing machine, a lesser amount of barrier and/or release components can be used compared with the amount of wax used on waxed paper prepared by dry waxing. It is expected that the total solids content of the emulsion applied to a paper base sheet per unit area can be less than the total solids content of the dry wax applied to paper per unit area to provide equivalent release and/or barrier properties. Accordingly, a treated paper product according to the invention can weigh less than a dry waxed paper having comparable properties. It should be understood that the paper product according to the invention can be designed to have comparable properties to dry waxed paper or improved properties relative to dry waxed paper. Exemplary properties that can be equivalent or improved relative to dry wax paper include grease holdout, water holdout, water penetration resistance, wet tensile strength, high speed processing characteristics in the end use, and improved barrier to grease, oil, or water. It is believed that wet tensile strength can be improved because the paper product according to the invention can have more fibers per unit area than dry waxed paper. Additional finishing techniques can further improve the barrier performance of the surface treatment including calendering, supercalendering, hot calendering, hot soft nip calendering, steam calendering, and variations thereof.

The paper base sheet for treatment by the emulsion can be any paper base sheet having the properties desired for a treated paper product intended for a particular application. Exemplary applications for the treated paper product according to the invention include: as an interleaver for separating slices of cheese, slices of meat, and/or meat patties; as a quick service food wrap for wrapping food products such as sandwiches from a quick service restaurant; as an ice cream cone wrap for wrapping ice cream cones; and as a paper board for further poly coating to produce a product holding bacon (bacon board core stock). Treated paper product can be prepared for these applications with desired release and/or barrier properties without a step of off line wax coating.

The treated paper product can have a solids content resulting from the application of the water based emulsion that is sufficient to provide the desired barrier and/or release properties. In the case of the cheese interleaver, the resulting product can have between about 3 wt. % and 5 wt. % solids resulting from the emulsion. In the case of the ice cream cone wrap, the product can have between about 2 wt. % and about 5 wt. % solids resulting from the emulsion. In the case of the emulsion containing stearylated melamine, it is desirable for the emulsion applied to the paper base sheet to have a solids content of about 6%. This includes about 5% starch and about 1% stearylated melamine. The large amount of water present allows the emulsion to flow with a water-like consistency.

Now referring to FIG. 1, an exemplary schematic diagram showing a process for the manufacture of a treated paper product according to the invention is shown at reference numeral 10. It should be understood that the exemplary diagram in FIG. 1 includes many of the general operations carried out in commercial papermaking facilities. The equipment used in a particular operation may vary from facility to facility, but it is expected that the general operations will be present.

Starting material 12 generally includes wood pulp 14. As shown in FIG. 1, the wood pulp 14 is provided in the form of baled wood pulp or can be slush pulp from the pulp mill. The wood pulp 14 is introduced into a hydrapulper 18 to provide a slurry 20. The slurry 20 is then conveyed via pump 22 and slurry line 24 to a refining operation 25. A refiner 26 operates on the slurry 20 to increase the bonding of the fiber and shorten and control the fiber length to provide a refined fiber product 28.

The refining operation 25 can also be carried out to hydrate the cellulosic fiber to provide a base sheet having desired barrier properties. The refiner 26 can be, for example, a double disc refiner, a conical refiner, or a Hollander beater. The refiner shown is a double disc refiner 30.

The refined fiber product 28 is conveyed through the refined fiber conveyor line 32 to a cleaning operation 40. The cleaning operation 40 can include a series of hydrocyclones 44 for removing high density and low density particulates. A screening system may be present after the cleaning operation 40 to remove foreign matter.

The cleansed fiber 46 resulting from the cleaning operation 40 is conveyed through the cleansed fiber delivery line 48 to a paper forming operation 50. The paper forming operation 50 shown in FIG. 1 can be referred to as a fourdrinier process 52. The fourdrinier process 52 includes a rotating screen 54 upon which the cleansed fiber 46 is applied to form a paper base sheet 60. In general, the cleansed fiber 46 can be applied through the head box 62 to allow the cleansed fiber 46 to be laid down on the rotating screen 54. It should be understood that the rotating screen 54 is often referred to as the wire. The cleansed fiber 46 is applied to the rotating screen 54 over the breast roll 64, and the paper base sheet 60 is removed from the rotating screen 54 over the couch roll 66. A dandy roll 68 can be used to help orientate and distribute the cleansed fiber 46 across the rotating screen 54 to provide a desired fiber distribution. A suction box 70 can be provided to help remove water from the paper product 60.

Certain chemicals are often added during a conventional paper making process from the hydrapulper to the headbox. The addition of chemicals during these operations is often referred to as "wet end chemistry." In general it is expected that wet end chemistry will provide a fairly even distribution of the applied chemicals through the thickness of the resulting paper product.

The cleansed fiber 46 can have a solids content of about 0.5% before it is applied to the rotating screen 54. It should be understood that the solids content refers to the fiber content of the aqueous slurry. After the paper 60 passes over the couch roll 66, the paper can have a solids content of between about 15% and about 20%.

The paper base sheet 60 then moves through a press operation 72 for the removal of water. In general, pairs of rollers 74 and 76 are provided for pressing the paper base sheet 60 for squeezing out water. Felts 78 can be used to help pull water out of the paper base sheet 60.

The paper base sheet 60 is then processed through a dryer section 80. In general, the paper base sheet 60 flows over cylinders 82 that heat the paper base sheet 60 and drive off water. The cylinders 82 can be filled with high pressure steam. The thermal energy from the cylinders 82 causes the water in the paper base sheet 60 to vaporize. Dryer felts 84 and 86 can be used to help hold the paper base sheet 60 against the cylinders 82.

An emulsion applicator 90 can be provided for the delivery of a water based emulsion to the paper base sheet 60. Before the paper base sheet 60 is dried to a final water content desirable for sale to customers, the paper base sheet 60 can be referred to as green sheet 94. In general, the green sheet 94 can have a water content of between about 0 and about 15 wt. %. The emulsion can be applied to the surface of the green sheet 94 by the emulsion applicator 90. Once the emulsion is applied to the green sheet 94, the treated paper product 98 can be further dried to remove water from the emulsion in an additional drying operation 110. The additional drying operation 110 can include non-contact dryers and/or cylinders 112 for driving off water, and felts 114 and 116 for holding the treated paper product 98 against the cylinders 112.

The treated paper product 98 can then be calendared on or off machine by using steel, soft nip, or supercalenders and taken up in a roll. In a subsequent operation 120, the roll can be unwound and cut to a desired width and then wound into a roll for distribution to a customer.

The emulsion can be applied to the paper base sheet 60 at the emulsion applicator 90. The application of the emulsion in combination with the wet end chemistry controls how much of the emulsion penetrates into the paper base sheet, and how much remains on the surface. This balance of penetration and soak in can be provided differently for each application. That is, the penetration and soak in of the water based emulsion into the paper base sheet 60 can vary depending upon the desired final product.

The emulsion applicator 90 can be any structure that adequately applies the emulsion to the paper base sheet 60. The emulsion applicator 90 shown in FIG. 1 is a size press 96. Exemplary alternative emulsion applicators include a metering size press, a spray applicator, a blade coater, bil blade coater, rod coater, curtain coater, and gate roll coaters. A conventional size press 96 can generally be characterized as having a pair of nipped rolls 122 and 124 and a nip shower bar 126 that allow for the formation of a puddle of the emulsion on both sides of the paper base sheet passing through the nipped rolls. The metering size press includes a roll that applies the emulsion to each side of the paper base sheet as the paper base sheet contacts the applicator rolls. A pump or meter can be used to control the amount of emulsion applied to the roll and subsequently applied to the paper base sheet. Another roll can be provided downstream of the first roll to apply the emulsion to the opposite side of the paper base sheet. A spray applicator can be used to spray the emulsion onto the paper base sheet. Control of the base sheet properties such as porosity and sizing, in combination with control of the emulsion solids and rheology results in control of the treatment level in a conventional size press application.

The step of applying the emulsion to the paper base sheet 60 can be characterized as occurring on a paper manufacturing machine. That is, the steps of forming the paper and applying the emulsion can occur on a single processing line without having to ship the paper base sheet to another location for application of the emulsion. In the case of dry waxing, the paper base sheet is typically shipped to a converter who applies the wax to the paper base sheet. In contrast, the emulsion can be applied on line with the manufacture of the paper base sheet.

The treated paper product according to the invention can be used in applications where barrier and/or release properties are desired. One general area in which barrier and/or release properties are desirable is in applications where the treated paper product contacts food. In certain types of food applications, it is desirable for the treated paper product to have sufficient barrier properties to resist penetration of grease, water, beverages, food or meat juices. In other types of food applications, it is desirable for the treated paper product to have sufficient release properties to allow the treated paper product to peel away from the food, leaving the food intact without fibers being transferred to the food. In certain applications, it is expected that the treated paper product will become saturated with fluid resulting from contact with the food and it is expected that the treated paper product will peel away from the food without disintegrating. In addition, there may be applications where both barrier and release properties are desired. When the treated paper product is intended to be used in contact with food, it is desirable for the barrier chemical emulsion to be FDA compliant for food contact with aqueous and fatty foods.

A barrier property that is desirable for the treated paper product according to the invention is grease and water holdout. The treated paper product according to the invention can exhibit a level of grease and water holdout sufficient to prevent a drop of water placed on one surface of the treated paper product from wicking through to the other side of the treated paper product. It is expected that the drop of water will evaporate before it wicks through the thickness of the treated paper product to cause staining on the other side of the treated paper product. In addition, the treated paper product according to the invention can exhibit a desired level of grease and water hold out sufficient to reduce edge wicking. In general, edge wicking results in movement of water and/or grease in the x and y plane of the treated paper product. In the case of a bacon board product provided in contact with bacon in a vacuum-packed wrapper, edge wicking is a concern because it can cause discoloration of the bacon board product.

The treated paper product according to the invention can be provided in several different food contact applications including bacon board core stock, ice cream cone wrapper, interleaver, and quick service food wrap. Each of these specific food contact applications is discussed below.

Bacon Board Core Stock

The bacon board core stock provides a base for poly coating and provides water resistance when the edges of the product are exposed to bacon product after die cutting. The invention provides a "board" base exhibiting desired stiffless and processability for poly coating operations. The surface allows for a smooth layer of poly to be applied and then printed. The board itself has excellent water repellency, both on the surface and in the x and y direction of the sheet. This provides the "edge wick" resistance that is desired when the product is die cut and then exposed to the bacon in the sealed package.

The bacon board core stock product can be prepared from a paper base sheet to provide a treated paper product having a weight of between about 85 lb/3000 $ft^2$ and about 150 lb/3000 $ft^2$. The bacon board core stock can have a Sheffield Smoothness according to TAPPI T538 of less than 200 Sheffield units and preferably about 120 Sheffield units; a Hercules size test (HST) at 80% reflectance #2 ink of at least 100 seconds and preferably about 10,000 seconds; a water cobb according to TAPPI T441 of less than 30 $g/m^2$ and preferably about 15 $g/m^2$; and an edge wicking weight gain of less than 6% and preferably about 4%. Edge wicking weight gain can be evaluated by submerging a 4 inch by 4 inch sample of paper in water under 25 inches Hg vacuum for 10 minutes. The samples are weighed prior to and after submerging and the percent weight gain is the edge wicking weight gain. The bacon board core stock can be poly coated on one or both sides to provide a laminate that can be packaged with bacon.

Ice Cream Cone Wrapper

The ice cream cone wrapper according to the invention exhibits a desirable level of release properties. The wrapper material cleanly releases from the ice cream cone after manufacture of the ice cream cone. The sheet must contain minimal curl upon printing and during manufacture of the ice cream cones. If significant curl is encountered, productivity losses can be expected. The paper product according to the invention can have a print surface acceptable for conventional flexographic printing presses and offset printing presses as compared to off machine waxed products. The paper product must be able to provide a surface capable of adhering (bonding) the ice cream cone wrapper to itself using a corn syrup based adhesive. Too much penetration of the adhesive into the wrapper is undesirable because it can be perceived as contamination (grease spot) to the final consumer.

The ice cream cone wrap can be prepared from a paper base sheet to provide a treated paper product having a weight of between about 20 lb/3000 $ft^2$ and about 80 lb/3000 $ft^2$. An ice cream cone wrap according to the invention can have properties of cobb size (2 min., felt) according to TAPPI T441 of between about 15 and about 32 $g/m^2$; a MacBeth brightness according to TAPPI T452 of between about 80% and about 91%; a felt-side smoothness according to TAPPI T538 of less than about 240 SSU; a wire-side smoothness according to TAPPI T538 of less than about 240 SSU; a felt-side wax pick test according to TAPPI T459 of at least about 20 CWSN; and a wire-side wax pick test according to TAPPI T459 of between about 20 CWSN. The ice cream cone wrap can have an opacity according to TAPPI T425 of between about 82% and about 91%.

Interleaver

The interleaver can be used with at least one of cheese, meat, meat patties, frozen meat, ground meat and butter to provide separation and dispensing. For example, the interleaver can be used with sliced cheese and/or sliced meat and should provide sufficient release properties to function as a slice interleaving paper that provides separation of slices and dispensing of slices. Fibers in the paper should not become imbedded in the cheese or meat slices. The paper should provide desired performance under varying conditions of temperature, moisture, pH, and long storage periods often encountered in cheese and/or meat processing. It is desirable for the treated paper to maintain physical strength after absorbing fluids as a result of contact with cheese and meat. The interleaver should not alter the taste or smell of any cheese and/or meat product it contacts. The interleaver should be able to run acceptably in the various cheese and/or meat processing equipment. This includes the ability to cut the sheet cleanly and properly feed high speed converting equipment (i.e., Schindler cheese processing equipment). It is an advantage of the invention that the treated paper does not produce a detrimental buildup on converting equipment such as rolls in contrast to the buildup provided by certain dry waxed paper products.

An interleaver can be prepared from a paper base sheet to provide a treated paper product having a weight of between about 10 lb/3000 $ft^2$ and about 55 lb/3000 $ft^2$. An interleaver that can be used with cheese and/or meat can be characterized as having a wet tensile strength (cd) according to TAPPI T456 of between about 2 lb./in. and about 5 lb./in.; a wet tensile strength (md) according to TAPPI T456 of between about 6 lb./in. and about 9 lb./in.; a tear cd-Elmendorf according to TAPPI T-414 of between about 40 $g_f$ and about 55 $g_f$; a tear md-Elmendorf according to TAPPI T-414 of between about 30 $g_f$ and about 45 $g_f$; a short span compressive strength (STFI)CD according to TAPPI T-426 of between about 10 lb./in. and about 12 lb./in.; a short span compressive strength (STFI)-MD according to TAPPI T-826 of between about 4 lb./in. and about 6 lb./in. The interleaver can have a MacBeth brightness according to TAPPI T452 of at least about 83%, and the MacBeth brightness can be between about 83% and about 88%.

Quick Service Food Wrap

The quick service food wrap should be capable of wrapping an article of food such as a sandwich. The paper protects the integrity and wholesomeness of the article of food. In addition, the paper prevents the passage of grease and oil, but allows the passage of water vapor. In addition, the paper product maintains strength when wet.

The quick service food wrap can be prepared from a paper base sheet having a weight of between about 16 lb/3000 $ft^2$ and about 45 lb/3000 $ft^2$. A quick service food wrap can exhibit a wet tensile ratio according to TAPPI T-410 of at least 5%, and preferably about 15%; oleic acid resistance of not less than 30 seconds, and preferably about 175 seconds; a Dupont water repellency of at least 2 and preferably about 4; and a water cobb according to TAPPI T441 of no more than 25$g/m^2$ and preferably about 15 $g/m^2$. Oleic acid resistance can be determined by placing a 4 inch by 4 inch sample of paper on a white backing paper, placing approximately 5 g of 25 mesh quartz testing sand on top of the sample, saturating the sand with dyed oleic acid, and reporting the time from saturating the sand until the dyed oleic acid penetrates the sample and stains the backing paper. The Dupont water repellency test involves placing an 8.5 inch by 11 inch sample of paper on a 45 degree angle rack, dropping a drop of water onto the paper from a distance of 1 inch, and observing the trail left by the water drop. A rating of 5 reflects a perfect roll off with no drops left, a rating of 4.5 reflects few round drops on trail, a rating of 4 reflects round drops covering ¼ of the trail, a rating of 3.5 reflects oblong drops covering ¼ of the trail, a rating of 3 reflects ½ of the trail wetted, a rating of 2 reflects a broken wet trail much narrower than the drop, a rating of 1 reflects an even wet trail slightly narrower than the drop, and a rating of 0 reflects an even wet trail as wide as the drop.

EXAMPLE 1

A bacon board core stock product can be produced on a standard fourdrinier paper machine with an on-line coater capable of saturating the sheet. The furnish for the sheet is comprised of 50% Hardwood refined to a 450 csf level, and 50% Southern Softwood refined to a 450 csf level and a 2.0 mm fiber length. The sheet is produced under alkaline/neutral pH conditions of 7.5 to 8.0, with the addition of 5# of alkyl ketene dimer (AKD) sizing. To assist with the sizing, sodium bicarbonate is added to provide a total alkalinity of at least 250. The sheet is formed, pressed and dried to a 5% moisture level prior to entering the on-machine coater. The coating is prepared prior to the machine with the addition of water and a rheology modifier that provides a Brookfield viscosity around 500 cp, and a solids level of 20%. This specific example is related to a film forming coater, like a gate roller. The solids level would be around 10% for a traditional size press coating. The coating is applied at a 4#/ream level, and then the sheet is dried and then calendered to a 100 Sheffield Smoothness level on at least one side, and an 8.2 mil finished caliper. The final sheet properties include a total gurley stiffness around 3000 g, and a water cobb test of 21 to 25 grams. Other sheet properties include aqueous HST levels greater than 4000 seconds.

EXMAPLE 2

An ice cream cone wrapper product can be prepared having the furnish and surface treatment identified in Table 1.

TABLE 1

| | |
|---|---|
| FURNISH: | |
| Virgin cellulose wood pulp - Hardwoods | 40–50% |
| Virgin cellulose wood pulp - Softwoods | 40–50% |
| Fortified rosin size | <1.0% (0.25%) |
| Acid Alum | <1.0% (0.75%) |
| Cationic potato starch | 1.0% |
| Dye(s) approved for food contact | <1.0% (0.0005%) |
| Calcined clay | 0.0%–1.25% |
| Aluminum trihydrate | 1.6%–2.5% |
| SURFACE TREATMENT: | |
| Anionic oxidized corn starch | 2.25% |
| Bis[(Methoxymethyl) tetrakis (octadecyloxy) methyl)] melamine | 0.40% |

Properties of the ice cream cone wrapper product are identified in Table 2.

TABLE 2

| Property | Units | Reference | Range |
|---|---|---|---|
| Basis Weight | lbs/3000 $ft^2$ | TAPPI T410 | 52.3–57.8 |
| Caliper | mil | TAPPI T411 | 4.1–4.7 |
| Gurley Densometer | sec./100 ml. | TAPPI T460 | 10–40 |
| Cobb Size (2 min., felt) | $g/m^2$ | TAPPI T441 | 15–32 |
| MacBeth Brightness | % | TAPPI T452 | 80–91 |
| Opacity | % | TAPPI T425 | 82–91 |
| Smoothness, Felt-side | SSU | TAPPI T538 | 100–180 |
| Smoothness, Wire-side | SSU | TAPPI T538 | 100–180 |
| Tape Adhesion, Felt-side | oz/in. | TAPPI T816 | 14–28 |
| Stiffness - Taber CD | g-cm | TAPPI T489 | 1–3 |
| Stiffness - Taber MD | g-cm | TAPPI T489 | 3–6 |
| Dry Tensile Strength, CD | lb./in. | TAPPI T456 | 16–25 |
| Dry Tensile Strength, MD | lb./in. | TAPPI T456 | 37–64 |
| Wax Pick Test, Felt-side | CWSN | TAPPI T459 | 20–22 |
| Wax Pick Test, Wire-side | CWSN | TAPPI T459 | 20–22 |

EXAMPLE 3

A cheese interleaver product can be prepared having the furnish and surface treatment identified in Table 3.

TABLE 3

| | |
|---|---|
| FURNISH: | |
| Virgin cellulose wood pulp - Northern Softwood | 60–65% |
| Virgin cellulose wood pulp - Southern Softwood | 30–35% |
| Fortified rosin size | <1.0% (0.25%) |
| Acid Alum | <1.0% (0.75%) |
| Urea Formaldehyde Wet Strength Resin | <1.0% (0.5%) |
| Cationic potato starch | 1.0% |
| SURFACE TREATMENT: | |
| Anionic oxidized corn starch | 2.9% |
| Bis[(Methoxymethyl) tetrakis (octadecyloxy) methyl)] melamine | 0.50–0.55% |

The properties of the cheese interleaver product are identified in Table 4.

TABLE 4

| Property | Units | Reference | Range |
|---|---|---|---|
| Basis Weight | lbs./3000 $ft^2$ | TAPPI T410 | 30.4–33.6 |
| Caliper | Mil | TAPPI T411 | 3.0–3.6 |
| Gurley Densometer | sec./100 ml. | TAPPI T460 | 15–35 |
| Cobb Size (2 min., felt) | $g/m^2$ | TAPPI T441 | 15–25 |
| MacBeth Brightness | % | TAPPI T452 | 83–88 |
| Opacity | % | TAPPI T425 | 60 |
| Smoothness, Felt-side | SSU | TAPPI T538 | 200–360 |
| Smoothness, Wire-side | SSU | TAPPI T538 | 200–360 |
| Tape Adhesion, both sides | oz/in. | TAPPI T816 | 14–18 |
| Stiffness - Taber CD | g-cm | TAPPI T489 | 0.1–1.0 |
| Stiffness - Taber MD | g-cm | TAPPI T489 | 0.4–1.5 |
| Dry Tensile Strength, CD | lb./in. | TAPPI T456 | 12–14 |
| Dry Tensile Strength, MD | lb./in. | TAPPI T456 | 30–37 |
| Wet Tensile Strength, CD | lb./in. | TAPPI T456 | 2–5 |
| Wet Tensile Strength, MD | lb./in. | TAPPI T456 | 6–9 |
| Tear CD-Elmendorf | $g_f$ | TAPPI T-414 | 40–55 |
| Tear MD-Elmendorf | $g_f$ | TAPPI T-414 | 30–45 |
| Short Span Compressive Strength (STFI)-CD | 16/in | TAPPI T-826 | 10–12 |
| Short Span Compressive Strength (STFI)-MD | 16/in | TAPPI T-826 | 4–6 |

EXAMPLE 4

A quick service food wrap can be prepared having the composition identified in Table 5.

TABLE 5

| Final Product Composition: |
|---|
| 75.5% southern softwood bleached kraft pulp, |
| 20.7% northern hardwood bleached sulfite pulp |
| 1.3% bleached chemi thermal mechanical pulp |
| 0.7% southern hardwood bleached kraft pulp |
| 0.2% Hercobond |
| 1.6% Michelman X350 thin |

Base paper furnish included cellulose fiber from wood pulp containing: 76.9% southern softwood bleached kraft pulp, 21.1% northern hardwood bleached sulfite pulp, 1.3% bleached chemi thermal mechanical pulp, and 0.7% southern hardwood bleached kraft pump. A polyamide wet strength resin (Hercobond 1004) is applied to the furnish in the wet end of the paper machine. Furnish solids are approximately 0.5% when polyamide wet strength resin is applied. The polyamide wet strength resin dosage is 5# dry/ton paper (0.25%).

The surface application includes a barrier chemical emulsion (available as Michelman X350 Thin), and is diluted with water from 48% solids to 8.6% solids and applied to the sheet of paper on a vertical size press. The moisture of the base sheet entering the size press is 1.5%. At the size press the sheet picks up 50 gallons of this solution for every 1000# of paper produced. The calculated treatment coat weight is 150# emulsion per ton of paper (72# dry/ton). This is equal to 0.756 dry pounds emulsion per ream of paper. A ream of paper is 3000 square feet. The percent composition of emulsion is 3.6%.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An interleaver prepared by applying a water based emulsion to a paper base sheet to provide an impregnated paper product and drying the impregnated paper product to provide an interleaver exhibiting:

(a) a MacBeth brightness according to TAPPI T452 of at least about 83%; a wet tensile strength (CD) according to TAPPI T456 of at least about 2 lb./in.; a wet tensile strength (MD) according to TAPPI T456 of at least 6 lb./in.; a Tear CD-Elmendorf according to TAPPI T-414 of less than about 55 $g_f$; a Tear MD-Elmendorf according to TAPPI T-414 of less than about 45 $g_f$; a short span compressive strength (STFI)-CD according to TAPPI T-426 of at least about 10 lb./in.; and a short span compressive strength (STFI)-MD according to TAPPI T-826 of at least about 4 lb./in;

(b) wherein the water based emulsion comprises a barrier and/or release forming component comprises at least one of stearylated melamine, polyethylene wax, paraffin wax, isoparaffin wax, microcrystalline wax, fluoropolymer wax, silicone wax, alkyl ketene materials, octyl succinic anhydride, Werner chrome complex, natural wax, or mixtures thereof;

(c) wherein the interleaver further comprises urea formaldehyde wet strength resin; and (d) wherein the interleaver is constructed for food contact with aqueous and fatty foods.

2. An interleaver according to claim 1, wherein the water based emulsion comprises stearylated melamine.

* * * * *

UNITED STATES PATENT AND TRADEMARK OFFICE

CERTIFICATE OF CORRECTION

PATENT NO. : 7,189,308 B2
APPLICATION NO. : 10/291810
DATED : March 13, 2007
INVENTOR(S) : Feit et al.

It is certified that error appears in the above-identified patent and that said Letters Patent is hereby corrected as shown below:

Col. 14, line 2, claim 1: "component comprises at least" should read --component comprising at least--

Signed and Sealed this

Twenty-third Day of October, 2007

JON W. DUDAS
*Director of the United States Patent and Trademark Office*